US006315028B1

(12) United States Patent
Inoue

(10) Patent No.: US 6,315,028 B1
(45) Date of Patent: Nov. 13, 2001

(54) EQUIPMENT FOR CIRCULATING BOX CONTAINING MODEL FOR MAKING MOLD UNDER REDUCED PRESSURES

(75) Inventor: Takao Inoue, Toyokawa (JP)

(73) Assignee: Sinktokogio, Ltd., Aichi Prefecture (JP)

( * ) Notice: Subject to any disclaimer, the term of this patent is extended or adjusted under 35 U.S.C. 154(b) by 0 days.

(21) Appl. No.: 09/310,282

(22) Filed: May 12, 1999

(30) Foreign Application Priority Data

May 14, 1998 (JP) ..... 10-131855

(51) Int. Cl.[7] ..... B22D 5/02; B22D 18/06
(52) U.S. Cl. ..... 164/323; 164/325; 164/7.1
(58) Field of Search ..... 164/7.1, 7.2, 160.1, 164/160.2, 323, 325

(56) References Cited

U.S. PATENT DOCUMENTS 2,985,926 * 5/1961 Fellows ..... 22/20
4,071,137 * 1/1978 Fink ..... 198/774
4,711,342 * 12/1987 Abraham ..... 198/463.3

FOREIGN PATENT DOCUMENTS 51-8890 3/1976 (JP) .
59-6733 2/1984 (JP) .

* cited by examiner

*Primary Examiner*—Tom Dunn
*Assistant Examiner*—Len Tran
(74) *Attorney, Agent, or Firm*—Gray Cary Ware & Freidenrich LLP

(57) ABSTRACT

Equipment for circulating a box containing a model and having a space in it for making a mold under reduced pressures is provided. It comprises walking conveyors 1 and 2, a traverser 3*a* that reciprocates along a line that combines the end of the walking conveyor 1 and the starting position of the walking conveyor 2, a conveyor 5 that is arranged along a line that combines the end of the walking conveyor 2 and the starting position of the walking conveyor 1, and fixed pressure-attachable and gas-transmitting valves 6, movable pressure-attachable and gas-transmitting valves 7, and a movable pressure-attachable and gas-transmitting valve 6A, which are used to make the space 23 in the box have reduced pressures, and optionally a conveyor 4 that intersects the walking conveyor 1 at the second station.

12 Claims, 7 Drawing Sheets

EQUIPMENT FOR CIRCULATING BOX CONTAINING MODEL FOR MAKING MOLD UNDER REDUCED PRESSURES

FIELD OF INVENTION

This invention relates to equipment for making a mold under reduced pressures while a box containing a model for making it is circulated in the equipment.

BRIEF DESCRIPTION OF THE DRAWINGS

FIG. 7(*b*) is a plan view of the box.

PRIOR ART

Figure 7:
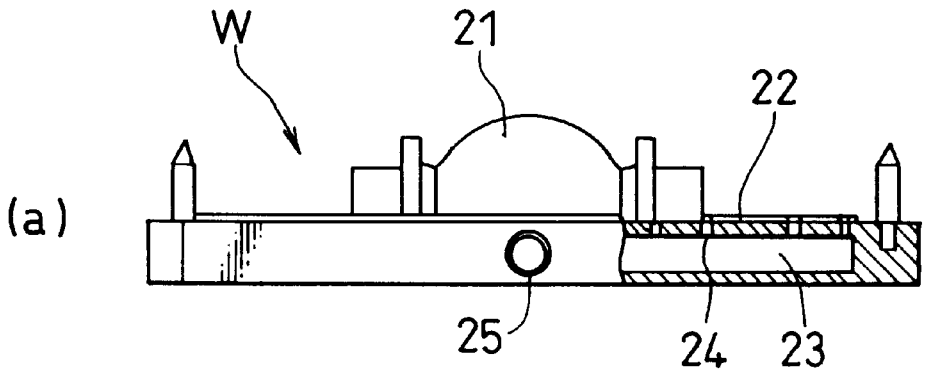
FIG. 7(*a*) is a front view with a partial section of a box containing a model for making a mold.
Figure 7:
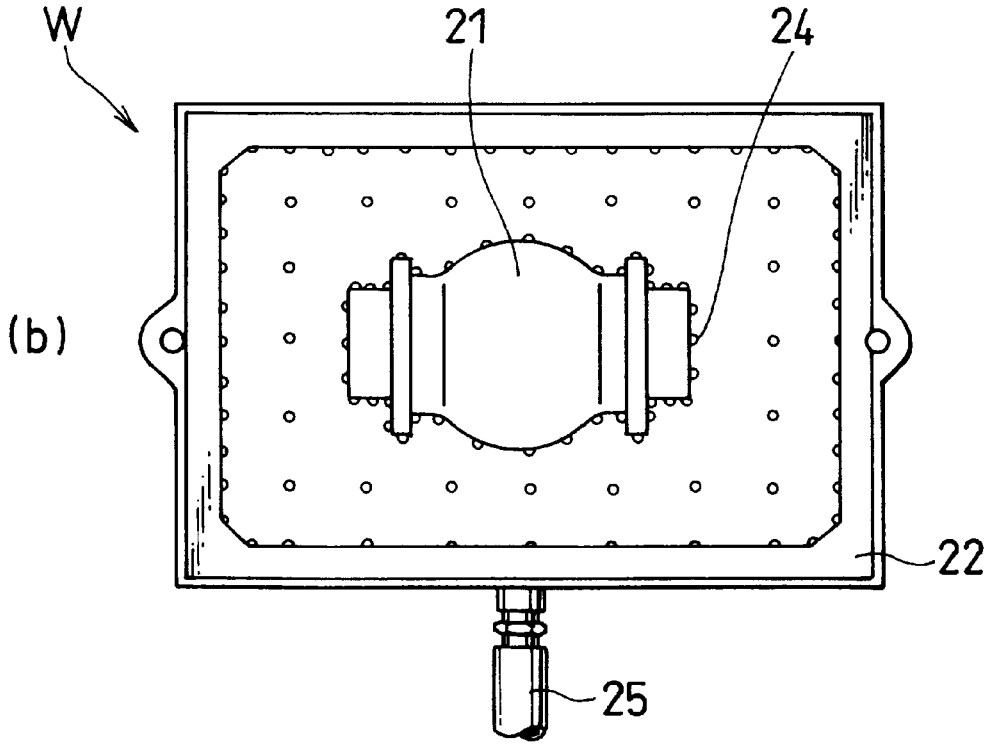

Japanese Utility Model Gazette Jikkosho No. 51-8890 (1976), the description of which is incorporated herein by reference, discloses a box containing a model for making a mold under reduced pressures. FIG. 7 shows the constitution of the box. FIG. 7(*a*) is a front view with a partial section. FIG. 7(*b*) is a plan view. As shown in these figures, a box W comprises a base board 22 to which a model 21 is attached. The base board 22 has a space 23 under the model 21. On the upper surface of the base board 22, many fine openings 24, which communicate with the space 23, are provided. Generally, the space 23 communicates with a vacuum pump (not shown) through a hose 25.

When a mold was conventionally made by using this box under reduced pressures, while the space of the box was in communication with a vacuum pump, the box was put on a turntable and was moved by successively turning the table from one station to another, e.g., from a film-molding station to a coating-applying station, from the coating-applying station to a flask-adapting station, or from the flask-adapting station to a mold-making station.

When the box was changed in the turntable system described above, one had to detach the hose from the box after it had been used, remove the box from the turntable, set a new box on the turntable, and connect the hose to the new box. Accordingly, to change the box, much labor and time was needed. Additionally, during the change, the work to make a mold had to be stopped. Thus, a problem arose, in that the working efficiency was low.

In recent years, because of environmental problems, solvents for coatings have been changing from alcoholic ones to aqueous ones. When an aqueous solvent is used, much time is spent to dry the coating. Therefore, two or more drying stations are needed. However, it is difficult to adapt the turntable system described above to equipment comprising two or more drying stations.

The present invention has been accomplished to overcome the above problems. It aims to provide equipment for circulating a box containing a model for making a mold under reduced pressures, by which a mold can be made while the reduced pressures in the box are maintained. In a preferred embodiment of the present invention, the box can also be easily changed.

SUMMARY OF THE INVENTION

The present invention provides equipment for circulating a box containing a model that has a space in the interior of the box for making a mold under reduced pressures. The equipment comprises first and second stepwise feeding means 1 and 2, each comprising at least one box-supporting means x, and at least two box-carrying means y, first transfer means 3 for carrying the box from the first stepwise feeding means 1 to the second stepwise feeding means 2, second transfer means 5 for carrying the box from the second stepwise feeding means 2 to the first stepwise feeding means 1, and fixed pressure-attachable and gas-transmitting valves 6 and movable pressure-attachable and gas-transmitting valves 6A and 7, which are used for reducing the pressure within the space 23 in the box. In this equipment the stepwise feeding means 1 and 2 are arranged in parallel to each other. On at least a part of the box-supporting means x, a processing(s) and/or a treatment(s) for making the mold is carried out. The first transfer means 3 is arranged along a line that combines the end of the first stepwise feeding means 1 and the starting position of the second stepwise feeding means 2, and can reciprocate. The second transfer means 5 is arranged along a line that combines the end of the second stepwise feeding means 2 and the starting position of the first stepwise feeding means 1. Along the first and second stepwise feeding means 1 and 2, fixed pressure-attachable and gas-transmitting valves 6 are arranged at their respective stations, other than the first and last stations, as the places where the processing(s) and/or treatment(s) for making the mold are carried out. The movable pressure-attachable and gas-transmitting valves 7 are arranged so that they move as the box-carrying means y move. The movable pressure-attachable and gas-transmitting valve 6A is arranged so that it moves as the first transfer means 3 moves.

In a preferred embodiment, the first and second stepwise feeding means 1 and 2 are walking conveyors, each comprising at least one fixed beam as the box-supporting means x and a pair of movable beams (e.g., walking beams) as the box-carrying means y, the first transfer means 3 comprises a traverser 3*a,* and the second transfer means 5 is a driven roller conveyor. The second transfer means 5 may be extended beyond the starting position of the first feeding means 1, to remove the box from the equipment. The equipment may further comprise a box-bringing-in means 4 (e.g., a driven roller conveyor) that is arranged so that it intersects the first stepwise feeding means 1 at the second station. The equipment may further comprise a fixed pressure-attachable and gas-transmitting valve 8, which is used for pressurizing and which is arranged at the last station.

That is, the present invention includes, as an embodiment, equipment for circulating a box that contains a model for making a mold under reduced pressures, which equipment comprises walking conveyors 1 and 2, each comprising at least one fixed beam x and a pair of movable beams y, a traverser 3*a,* two conveyors 4 and 5 (e.g., driven roller conveyors), and fixed pressure-attachable and gas-transmitting valves 6, movable pressure-attachable and gas-transmitting valves 7, and a movable pressure-attachable and gas-transmitting valve 6A, which are used for pressure-reducing; wherein the walking conveyors 1 and 2 are arranged in parallel to each other and have a number of stations where processings and treatments for making the mold are carried out, the traverser 3*a* can reciprocate along a line that combines the end of the walking conveyor 1 and the starting position of the walking conveyor 2, one conveyor 4 for supplying the box W containing a model is arranged so that it intersects the walking conveyor 1 at the second station, one conveyor 5 for taking the box W containing a model off the circulation line of the equipment is arranged along a line that combines the end of the walking conveyor 2 and the starting position of the walking conveyor 1, the fixed valves 6 are arranged at the respective stations, the movable valves 7 are arranged so that they move as the movable beams y move, and the movable valve 6A is arranged so that it moves as the traverser 3*a* moves.

DETAILED DESCRIPTION OF PREFERRED EMBODIMENTS

The preferred embodiments of this invention will now be explained by reference to the accompanying drawings.

Figure 1:
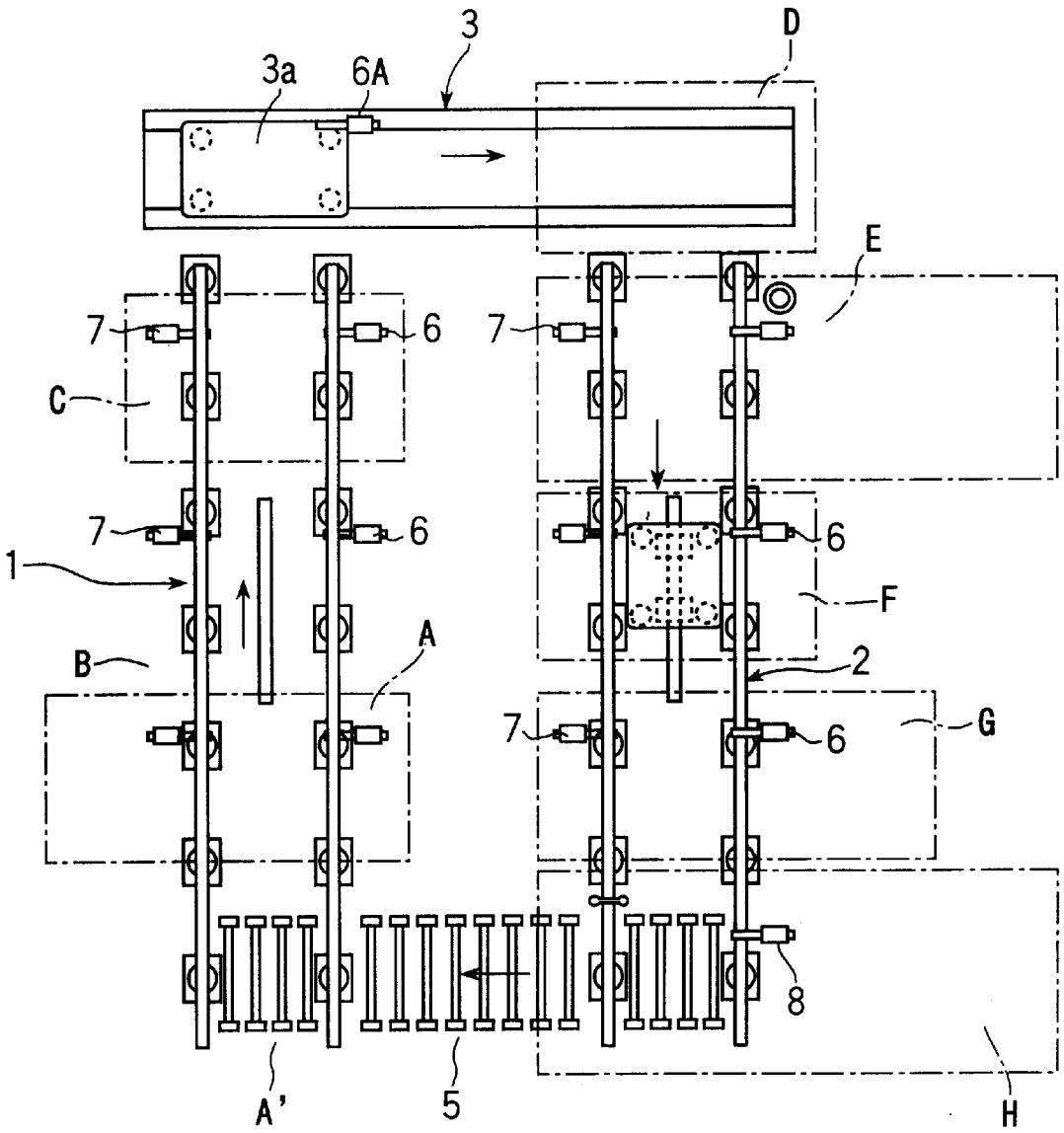
FIG. 1 is a plan view of an embodiment of this invention.

FIG. 1 shows one embodiment of the equipment of this invention. As in FIG. 1, near a walking conveyor 1 there are four stations A', A, B, and C. At their respective stations four boxes W, each containing a model for making a mold, are kept while they are being processed or treated. Near a walking conveyor 2, there are four stations E, F, G, and H. Also, four boxes W, one for each station, are also kept there while they are being processed or treated. These conveyors 1 and 2 are parallel to each other. A traverser 3*a* can reciprocate along a line that combines the end of the walking conveyor 1 and the starting position of the walking conveyor 2. After a mold is made, a driven roller conveyor 5 brings the box W from the last station H to the first station A', i.e., to the starting position of the walking conveyor 1.

In FIG. 1, at the first station A', the box W is put on the walking conveyor 1 by a machine or manually, or the box W that was previously used rides on the walking conveyor 1. At the second station A, a model is covered with a film. At the third station B, a coating is applied on the film. At the fourth station C, the coating is dried. Also at the position D, the coating is dried on the traverser 3*a*. At the fifth station E (i.e., the first station of the walking conveyor 2) a flask is placed on the box W. At the sixth station F, the flask is filled with sand. At the seventh station G, a film is set on the upper surface of the flask. At the last station H, a mold is drawn. When the box W that has been used is not to be recycled, it is taken off at the last station H. At the first station A' or second station A a new box W' is put on the walking conveyor 1.

Figure 4:
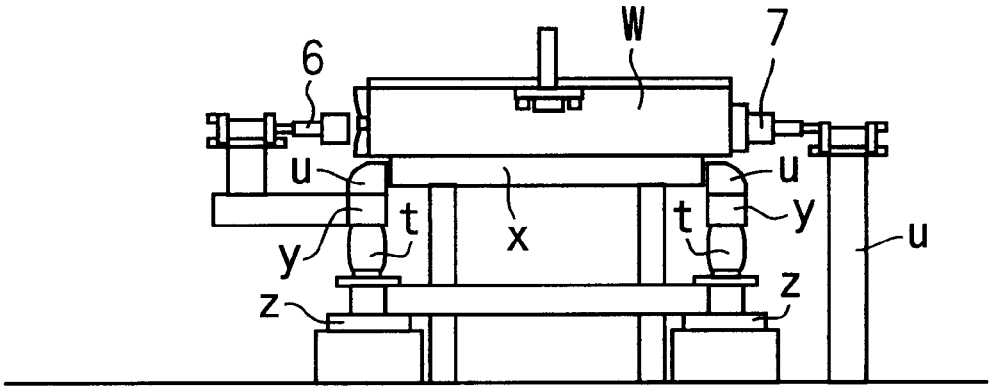
FIG. 4 is an elevational view showing the relationship among a box, a fixed beam, movable beams, a fixed valve, and a movable valve.

At the respective stations, other than the first and last stations, fixed pressure-attachable and gas-transmitting valves 6 are provided. They may be fixed on the floor (as shown in FIG. 4), to a fixed beam x, or on fixed frames provided outside the walking conveyors 1 and 2. Movable pressure-attachable and gas-transmitting valves 7 may be combined with one of a pair of movable beams y as shown in FIG. 4. These valves 6 and 7 are not provided at the first and last stations. The reason is that at the first station A' no processing or treatment is carried out and that at the last station H, for removing a mold, the vacuum condition should be released. At the position of the traverser 3*a,* which position corresponds to that of the fixed valves 6, a movable pressure-attachable and gas-transmitting valve 6A is also provided to maintain the reduced pressure in the box. This valve 6A moves as the traverser 3*a* moves. In this preferred embodiment, also at the last station H, a fixed pressure-attachable and gas-transmitting valve 8 is provided. This valve 8 is used to apply pressure within the space 23 formed in the box W. That is, through the valve 8 compressed air is blown into the space 23 to peel the film from the X upper surface of the model.

Now, the structure of a valve 6, 6A, or 7, and the structure of a valve of a box W, are explained. Their details are shown in Japanese Patent Publication B2 59-6733 (published Feb. 14, 1984), which is incorporated herein by reference.

Figure 6:
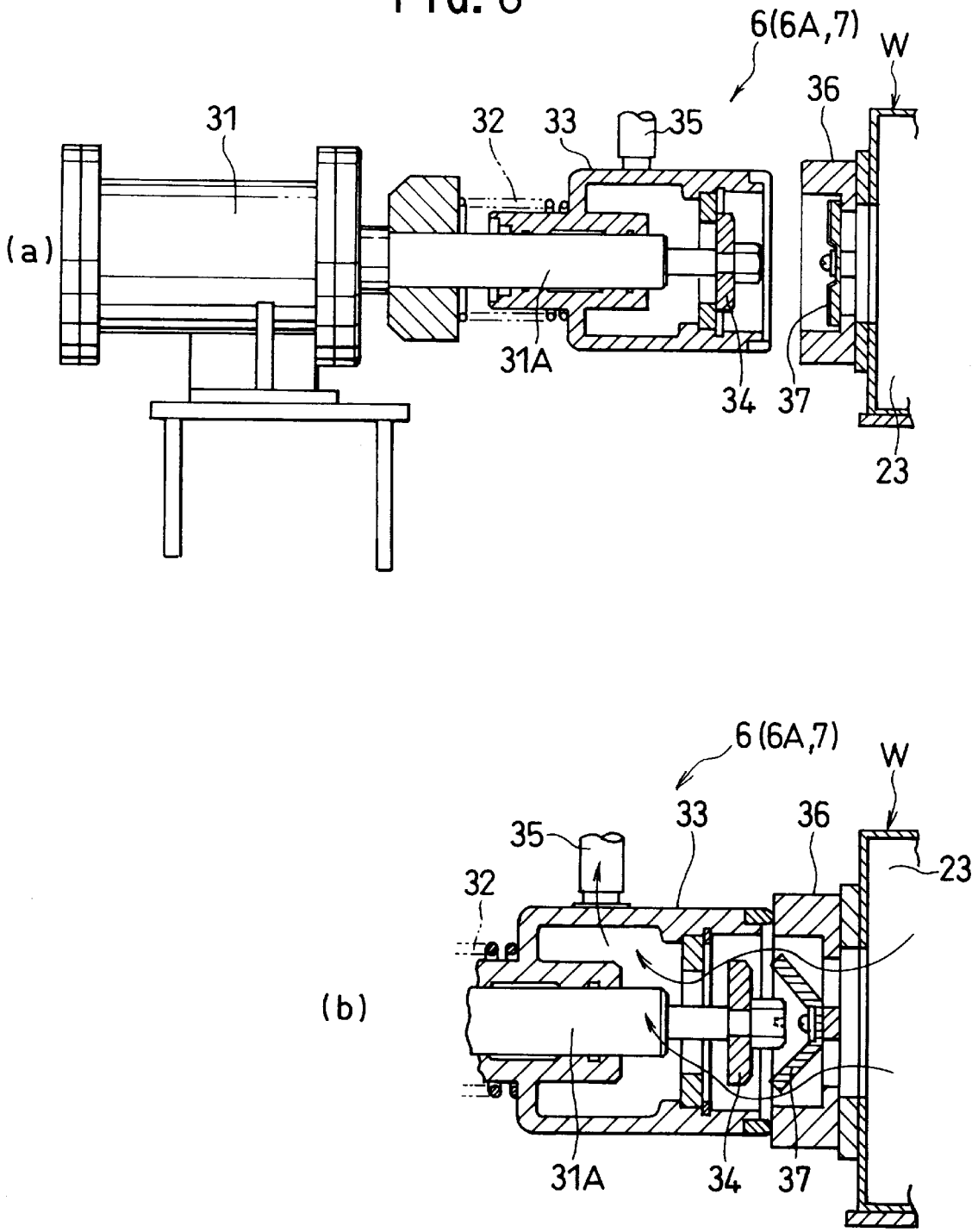
FIGS. 6(*a*) and (*b*) are sectional views showing the relationship between a pressure-attachable and gas-transmitting valve and a gas-transmitting valve of a box (a: closed; b: opened).

FIG. 6(*a*) shows a sectional view of a valve 36 provided on a box W and a valve 6, 6A, or 7, which are separated from each other. In a cup 33, which is pushed and drawn back by the functions of a cylinder 31 and a spring 32, an opening-closing valve 34, which is combined with a piston rod 31A, is provided. To the cup 33, a hose 35 that communicates with a vacuum pump (not shown) is connected. Thus, in the cup 33 air is always aspirated to depressurize the space 23.

FIG. 6(*b*) shows a sectional view of the valve 36 of the box W connected to the valve 6, 6A, or 7. By the function of the cylinder 31, the cup 33 is pressure-attached to the gas-transmitting valve 36 of the box W. By carrying the opening-closing valve 34 forward against the force of the spring 32, the depressurizing force also acts on the gas-transmitting valve 36 to open a butterfly valve 37. Thus, the cup 33 communicates with the space 23 of the box W, and the pressure in it is reduced.

The valves 6, 6A, and 7 are not limited to those described above. As long as they are pressure-attachable and usable to reduce the pressure, any one can be used. Although in FIG. 1 the valves 6 and 7 are parallel, they need not be parallel, if they are both attachable to one box W.

Figure 2:
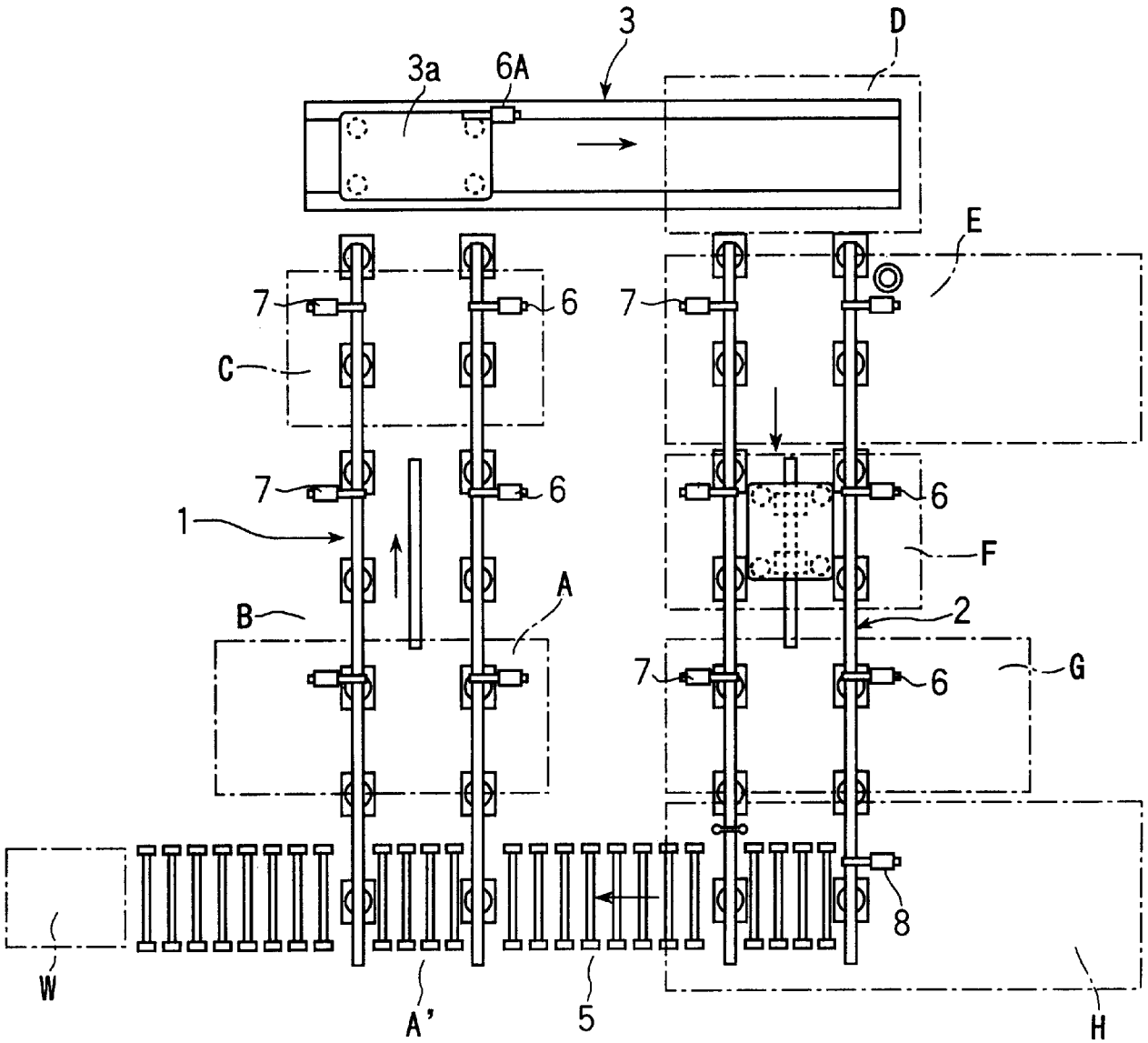
FIG. 2 is a plan view of another embodiment of this invention.

FIG. 2 shows another embodiment of the equipment of this invention. In this embodiment, a driven roller conveyor 5 extends beyond a walking conveyor 1. Thus, when a box W that has been used is removed from the circulation line of this equipment, it is brought beyond the first station A' by the driven roller conveyor 5. A new box W' is put on the walking conveyor 1 at the second station A. When the box W is not changed, it is put on the walking conveyor 1 at the first station A'.

Figure 3:
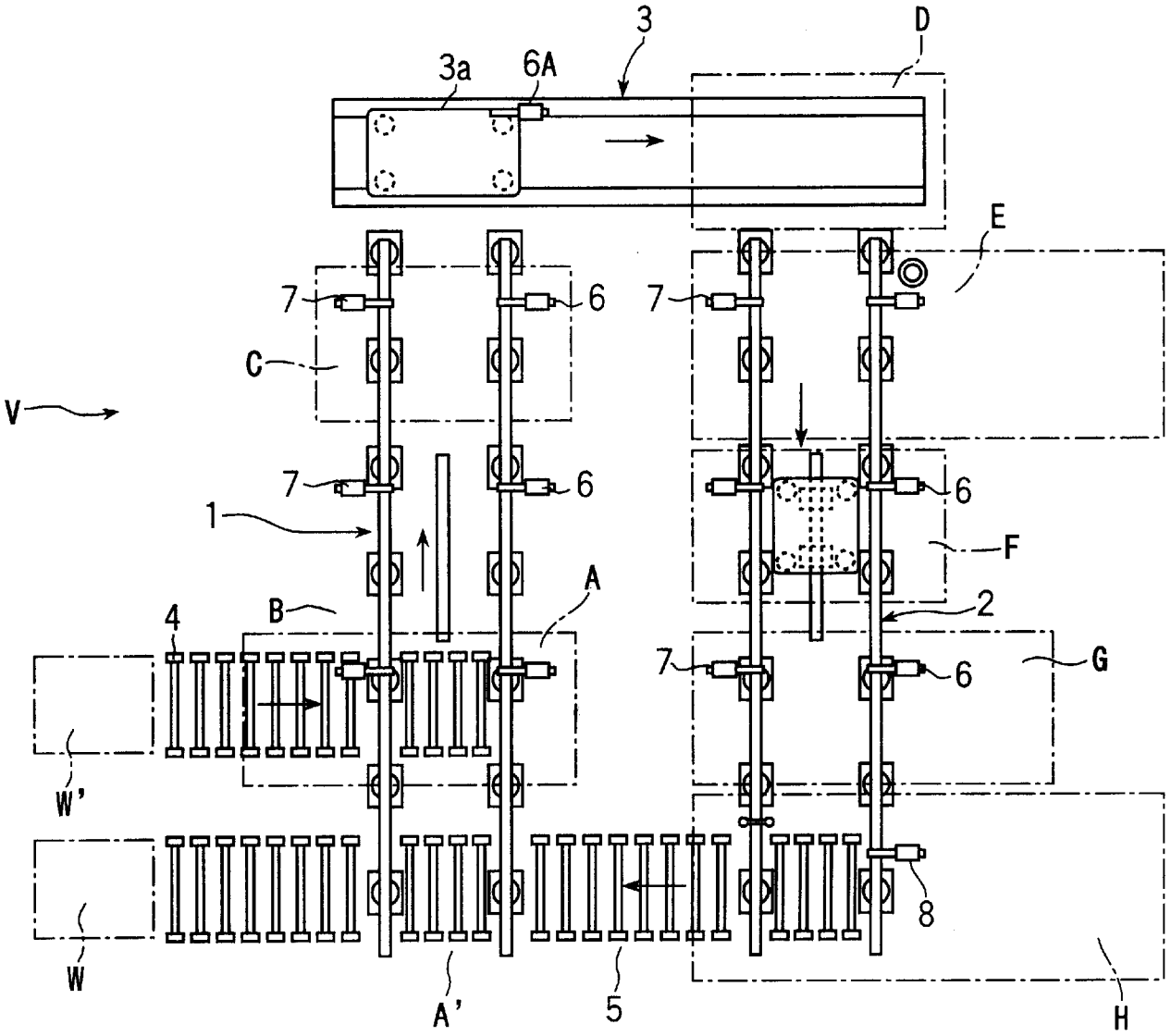
FIG. 3 is a plan view of a still another embodiment of this invention.

FIG. 3 shows still another embodiment of the equipment of this invention. In this embodiment, a driven roller conveyor 4, which acts as a box-bringing-in means, is arranged so that it intersects the walking conveyor 1 at the second station A. That is, when the box W that has been used is replaced by a new box W', the box W is brought beyond the first station A' by a driven roller conveyor 5, and the new box W' is brought into the circulation line of this equipment through the driven roller conveyor 4. When the box W is not replaced, it is put on the walking conveyor 1 at the first station A'.

The length of the walking conveyors 1 and 2 is not always the same. For example, when the walking conveyor 2 is longer than the walking conveyor 1 due to the number of stations, the driven roller conveyor 5 may be curved.

The fixed beam x is made of, e.g., an iron or a steel. It may be shaped like a ladder. Or, it may be shaped like a square rod. Or, it may be made by using a channel bar. In the latter two cases, a pair of fixed beams X are used. Further, respective stations may have respective fixed beams x. The movable beams y are also made of an iron or a steel.

At all stations, boxes W may be provided. Or, the boxes W may be provided at only some of them. The boxes W may be of the same type or may differ in shape from one another.

The positions of the fixed valve 6 and movable valve 7, each of which is provided at one side of the walking conveyor 1 and one side of the walking conveyor 2, can be reversed.

Function

By using the equipment of this invention that is shown in FIG. 3, a mold is made as follows:

First, a box W is put on a walking conveyor 1 at the second station A through a driven roller conveyor 4. At this station A, a fixed valve 6 is pressure-attached to the box W. Then, a film is put on and adsorbed onto a model by reducing the pressure inside a space 23 of the box W. Next, a movable valve 7 is pressure-attached and the fixed valve 6 is pulled out. By the function of movable beams y, the box W is lifted up and carried to the third station B while the reduced pressure in it is maintained by aspirating or withdrawing the air in the space 23 through the movable valve 7. At this station B, the box W is lowered and put on a fixed beam x (see FIG. 5). Then, a fixed valve 6 is pressure-attached to the box W, and the movable valve 7 is pulled out. Thereafter, a coating is applied to the film while the condition in the box W is maintained under reduced pressures. A valve 7 is pressure-attached and the valve 6 is pulled out, and the box W is lifted up and carried to the fourth station C in the same way as the box W is carried from the second station A to the third station B. At the fourth station C, the coating is dried after a valve 6 is pressure-attached and the valve 7 is pulled out. Then, a valve 7 is pressure-attached and the valve 6 is pulled out. The box W is transferred onto a traverser 3*a* while the condition in the box W is maintained under reduced pressures. At this position, a movable valve 6A is pressure-attached to the box W and the movable valve 7 is pulled out. The traverser 3*a* then moves, and at one end of the line along which it moves (position D), the coating is again dried to a suitable level. Then a movable valve 7 is pressure-attached to the box W and the movable valve 6A is pulled out. The box W is lifted up and carried to the fifth station E. At this station E, a flask is placed on the box W after a valve 6 is pressure-attached and the valve 7 is pulled out. In a way similar to that explained above, a valve 7 is pressure-attached and the valve 6 is pulled out, and then the box W and the flask are moved to the sixth station F. At this station F, dry sand is poured into the flask by a sand filler after a valve 6 is pressure-attached and the valve 7 is pulled out. In a way similar to that previously explained, a valve 7 is pressure-attached and the valve 6 is pulled out and then the box W is moved to the seventh station G. At this station G, after a valve 6 is pressure-attached and the valve 7 is pulled out, a film is put on the dry sand by a film-setting machine. Then, by another aspirating means, which is connected to the flask, the pressure in it is also reduced. Thus, the surface of the flask is sealed by the film and the dry sand is kept to be a solid in vacuo. By pulling out the fixed valve 6 from the box W, the condition in it is changed. That is, without maintaining the reduced-pressure condition in the box W while maintaining the reduced-pressure condition in the flask, they are carried to the eighth station H. At the last station H, a pressure-attachable and gas-transmitting valve 8 for pressurizing is attached to the box W. By a mold-drawing machine, the flask is lifted up. While drawing the mold, through the valve 8 compressed air is supplied to the space 23 within the box W. Thus, the film that was adsorbed on the model is peeled from the surface of it, and the film adsorbs onto the lower surface of the content in the flask, specifically, onto the lower surface of the dried coating.

Now, the lifting up and carrying of the box W is explained.

In FIG. 4, a fixed beam x is shaped like a ladder. As shown in FIG. 4, the width of the fixed beam x is smaller than that of a box W. When the box W is lifted up and carried, the tops of four receiving parts u (two of which are not shown), which are welded onto movable beams y, support the box W. By the function of, e.g., air springs z, the parts comprising the receiving parts u, a pair of movable beams y, and receiving rollers t are lifted up. After the tops of the receiving parts u have reached the bottom of the box W, the parts are further lifted up to lift the box W. Then, the box W is carried by the function of, e.g., oil pressure cylinders. More particularly, by the function of the oil pressure cylinders, their rods, which are connected to the movable beams y, are lengthened or shortened. As the rods move, the movable beams y move on receiving rollers t (see FIG. 5). Thus, the box W moves from one station to the next station. Then, the parts comprising the receiving parts u, etc. are lowered by the function of the air springs z, and the box W is placed on the fixed beam x. Then, only the movable beams y go back to their original positions by the function of the oil pressure cylinders.

In the present invention, for carrying the box W, besides the walking conveyor, any other means can be used. For example, two fulcrums (one for one side of the box W and one for the other side of it) may be provided between two stations. The arms that extend from the fulcrums move circularly to carry the box W.

When the box W is on the fixed beam x, a fixed valve 7 is used. In contrast, when the box W is moved, a movable valve 6 is used.

Figure 5:
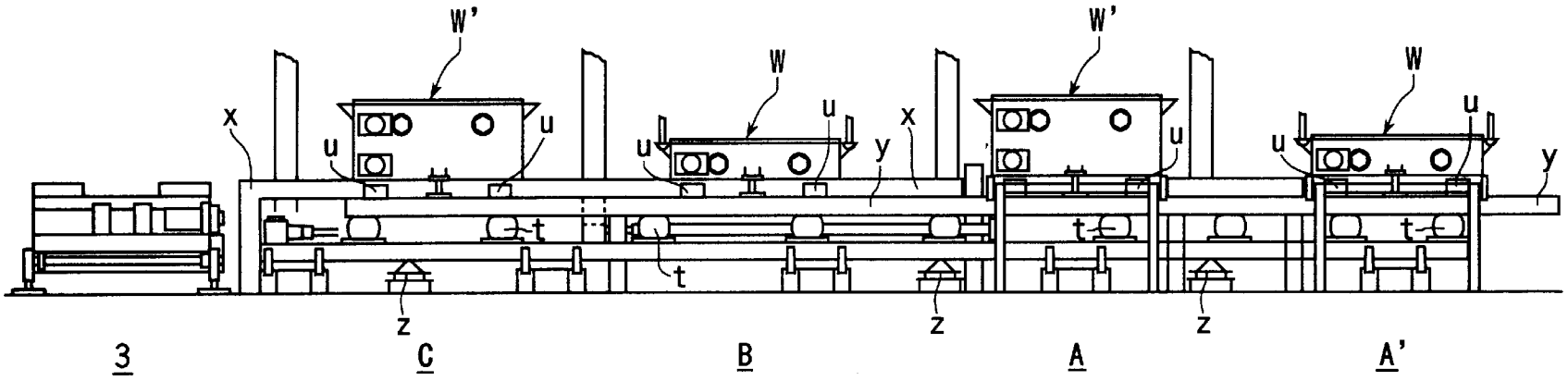
FIG. 5 is a side view of a part of an embodiment of this invention. However, in this figure, movable pressure-attachable and gas-transmitting valves 7 are omitted.

In the embodiment shown in FIG. 5, a walking conveyor 1 has one fixed beam x. However, the walking conveyors 1 and 2 may each have a plurality of fixed beams x. For example, the walking conveyor 1 may have two fixed beams x, one for the third station and one for the fourth station.

EFFECTS OF INVENTION

The equipment of this invention is constituted as above. Therefore, if a box containing a model for making a mold has two valves (e.g., one of which corresponds to the fixed pressure-attachable and gas-transmitting valves 6 and 8 and the movable pressure-attachable and gas-transmitting valve 6A, and one of which corresponds to the movable pressure-attachable and gas-transmitting valves 7), the mold can be made by circulating the box in the equipment of this invention while the reduced pressures in the box are maintained by aspirating gases through the valves by using, e.g., a vacuum pump. Further, the box can be circulated without a hose trailing from it. Additionally, when the second transfer means extends beyond the starting position of the first stepwise feeding means, so as to remove the box from the equipment, the box can be easily changed without any loss of time, particularly when the equipment also has a box-bringing-in means.

In the equipment of this invention, the number of stations can be freely changed. Therefore, by lengthening the stepwise feeding means, the number of drying stations can be increased, i.e., the time for drying the coating can be prolonged. In contrast, when the number of stations is small because, e.g., the coating-applying and drying steps are eliminated, the length of the stepwise feeding means may be shortened.

What is claimed is:

1. Equipment for circulating a box containing a model that has a space in the interior of the box for making a mold under reduced pressures, which equipment comprises first and second stepwise transporting means 1 and 2, each comprising at least one box-supporting means x and at least two box-carrying means y, first transfer means 3 for carrying the box from the first stepwise transporting means 1 to the second stepwise transporting means 2, second transfer means 5 for carrying the box from the second stepwise transporting means 2 to the first stepwise transporting means 1, and fixed pressure-attachable and gas-transmitting valves 6 and movable pressure-attachable and gas-transmitting valves 6A and 7, which are used for reducing the pressure with the space 23 in the box, wherein the stepwise transporting means 1 and 2 are arranged in parallel to each other, on at least a part of the box-supporting means x processing (s) and/or a treatment(s) for making the mold is carried out, the first transfer means 3 is arranged along a line that combines the end of the first stepwise transporting means 1 and the starting position of the second stepwise transporting means 2, and reciprocates, the second transfer means 5 is arranged along a line that combines the end of the second stepwise transporting means 2 and the starting position of the first stepwise transporting means 1, along the first and second stepwise transporting means 1 and 2 fixed pressure-attachable and gas-transmitting valves 6 are arranged at their respective stations, other than the first and last stations, as the places where the processing(s) and/or treatment(s) for making the mold are carried out, the movable pressure-attachable and gas-transmitting valves 7 are arranged so that they move as the box-carrying means y move, and the movable pressure-attachable and gas-transmitting valve 6A is arranged so that it moves as the first transfer means 3 moves.

2. The equipment of claim 1, wherein the first and second stepwise transporting means 1 and 2 are walking conveyors, each comprising at least one fixed beam as the box-supporting means x and a pair of movable beams as the box-carrying means y, the first transfer means 3 comprises a traverser 3*a,* and the second transfer means 5 is a driven roller conveyor.

3. The equipment of claim 1, wherein the second transfer means 5 extends beyond the starting position of the first stepwise transporting means 1 for removing the box from the equipment.

4. The equipment of claim 3, which further comprises a box-bringing-in means 4 that is arranged so that it intersects the first stepwise transporting means 1 at the second station.

5. The equipment of claim 4, wherein the box-bringing-in means 4 is a driven roller conveyor.

6. The equipment of any of claim 1, which further comprises a fixed pressure-attachable and gas-transmitting valve 8, which is used for pressurizing and which is arranged at the last station.

7. The equipment of claim 2, wherein the second transfer means extends beyond the starting position of the first stepwise transporting means for removing the box from the equipment.

8. The equipment of claim 7, which further comprises a fixed pressure-attachable and gas-transmitting valve 8, which is used for pressurizing and which is arranged at the last station.

9. The equipment of claim 2, which further comprises a fixed pressure-attachable and gas-transmitting valve 8, which is used for pressurizing and which is arranged at the last station.

10. The equipment of claim 3, which further comprises a fixed pressure-attachable and gas-transmitting valve 8, which is used for pressurizing and which is arranged at the last station.

11. The equipment of claim 4, which further comprises a fixed pressure-attachable and gas-transmitting valve 8, which is used for pressurizing and which is arranged at the last station.

12. The equipment of claim 5, which further comprises a fixed pressure-attachable and gas-transmitting valve 8, which is used for pressurizing and which is arranged at the last station.

* * * * *